US005607354A

United States Patent [19]

Mill et al.

[11] Patent Number: 5,607,354

[45] Date of Patent: Mar. 4, 1997

[54] AIR DISTRIBUTION SYSTEM

[75] Inventors: Peter Mill, Ottawa; Richard Tice, Halifax, both of Canada

[73] Assignee: Scots Pine Enterprises, Ottawa, Canada

[21] Appl. No.: 256,100

[22] PCT Filed: Nov. 9, 1992

[86] PCT No.: PCT/CA92/00485

§ 371 Date: Apr. 21, 1995

§ 102(e) Date: Apr. 21, 1995

[87] PCT Pub. No.: WO93/09387

PCT Pub. Date: May 13, 1993

[30] Foreign Application Priority Data

Nov. 8, 1991 [CA] Canada ..... 2055162

[51] Int. Cl.[6] ..... F24F 9/00; F24F 13/062

[52] U.S. Cl. ..... 454/189; 454/186; 454/290; 454/310; 454/311; 454/329

[58] Field of Search ..... 454/186, 189, 454/192, 256, 284, 289, 290, 310, 311, 322, 326, 327, 329

[56] References Cited

U.S. PATENT DOCUMENTS

| | | | |
|---|---|---|---|
| 2,499,856 | 3/1950 | Gilbert | 454/310 |
| 2,811,094 | 10/1957 | Auer | 454/310 |
| 4,874,127 | 10/1989 | Collier | 454/186 X |
| 5,350,337 | 9/1994 | Kondo et al. | 454/189 |
| 5,489,238 | 2/1996 | Asselbergs | 454/229 |

FOREIGN PATENT DOCUMENTS

| | | | |
|---|---|---|---|
| 0207718 | 1/1987 | European Pat. Off. . | |
| 166131 | 12/1933 | Switzerland | 454/310 |
| 503594 | 4/1939 | United Kingdom | 454/310 |
| 686666 | 1/1953 | United Kingdom | 454/311 |

*Primary Examiner*—Harold Joyce
*Attorney, Agent, or Firm*—Marks & Clerk

[57] ABSTRACT

An air distribution unit for mounting in the wall or floor of a room having a plenum space behind the wall or floor, comprises a housing having an air inlet for communication with the plenum space and an air outlet; a blower between the air inlet and air outlet for drawing air from the plenum space and exhausting it through the air outlet into the room; and a grill assembly mounted over the air outlet. The grill assembly has aerodynamically profiled air distribution channels which may be circumferentially disposed, extending between the upper and lower surfaces thereof. The air distribution channels open out onto the upper surface of the grill assembly at a shallow angle in a radially outward direction so that air flowing out of said channels is directed outwardly at an angle of between about 15° and 45° to the plane of the grill assembly.

10 Claims, 3 Drawing Sheets

AIR DISTRIBUTION SYSTEM

This invention relates to environmental systems, and more particularly to an air distribution unit for use in such systems.

There is increasing concern over the comfort of personnel in the work environment, both in terms of air quality on the one hand and temperature and humidity levels on the other. With the trend toward open plan designs and sealed buildings, it becomes more difficult to ensure the comfort of individual workers. Most large buildings have centralized air conditioning units that control humidity and temperature levels and also filter out undesirable contaminants. Due to the volume of air to be processed, it takes a considerable time to condition the air in the entire building, and furthermore workers often have different individual comfort levels.

Smoking is often a problem. In many instances this is banned altogether due to its undesirable impact on non-smokers. However, such a ban can detrimentally effect the efficiency of habitual smokers.

An object of the invention is to alleviate the aforementioned disadvantages by allowing the individual to exercise some degree of control over his or her personal environment.

According to the present invention there is provided an air distribution unit for mounting in the wall or floor of a room having a plenum space behind said wall or floor, comprising a housing having an air inlet for communication with the plenum space and an air outlet; blower means between said air inlet and air outlet for drawing air from the plenum space and exhausting it through the air outlet into the room; and a grille assembly mounted over said air outlet, said grille assembly having circumferentially disposed, aerodynamically profiled air distribution channels extending between the upper and lower surfaces thereof, and said air distribution channels opening out onto the upper surface of the grille assembly at a shallow angle in a radially outward direction so that air flowing out of said channels is directed outwardly at an angle of between about 15° and 45° to the plane of the grille assembly.

The above unit is intended primarily for use in a building provided with a plenum space below the floor or behind the wall. In the past, such designs have not been found effective due to the difficulty in maintaining correct pressures at the passive outlet grills, and as a result have tended to give way to fully ducted systems. In the inventive air distribution unit air is actively drawn by the blower from the plenum space so adequate distribution of air into the room is no longer a problem.

In a preferred embodiment the distribution unit is floor-mounted and comprises radial distribution channels. Because the air exiting the distribution channels has a vertical component of velocity, and due to the configuration of the channels and the reduced air pressure formed in the central zone of the grille assembly, it circulates in an essentially closed path to form a localized pocket of mainly fresh, conditioned, and preferably filtered, air distinct from the ambient air in the room. Some mixing with the ambient air will occur, but in a manner that avoids draughts and discomfort to people in the room.

The unit will normally be located directly under the individual to create the localized air pocket. It preferably also includes a phase-controlled, electrically powered fan controllable by the individual.

The underfloor plenum will normally contain clean conditioned air from the central building air conditioning system. Preferably, the unit also contains a filter to permit localized filtration of the air flowing through the unit immediately prior to formation of the air bubbles.

In this specification the term "air pocket" is used to identify the localized zone above the air distribution device that contains mainly fresh air, mixed with some ambient air, circulating in a generally closed path that has recently exited from the distribution device. The air in the pocket is distinctly identifiable from the ambient air in the room and separated from it by a boundary region.

The unit is preferably designed to be recessed into the floor so that the grille assembly is flush therewith.

In an alternative embodiment the housing can be made rectangular with the air distribution channels in the grille assembly extending in the longitudinal direction. This embodiment can be used to distribute air generally into the room without causing draughts or in the form of a suitable array of such units to create a larger pocket of fresh air then would be possible with a single cylindrical unit.

Accordingly the invention also provides a wall-mountable local air distribution unit, comprising an air intake, a blower for drawing ambient air from a room through said air intake and causing it to flow through said unit, air outlet means for directing conditioned air into a localized air conditioned zone in the vicinity of said air outlet, air conditioning means between said air intake and said air outlet means, control means for permitting personal control of said air conditioning means, and a discharge outlet directed away from said localized air conditioned zone for a heat transfer medium flowing through said air conditioning means.

Such a unit can be wall mounted, for example adapted to be fitted into a wall forming part of a workstation partition.

The invention will now be described in more detail, by way of example only, with reference to the accompanying drawings, in which.

Figure 1:
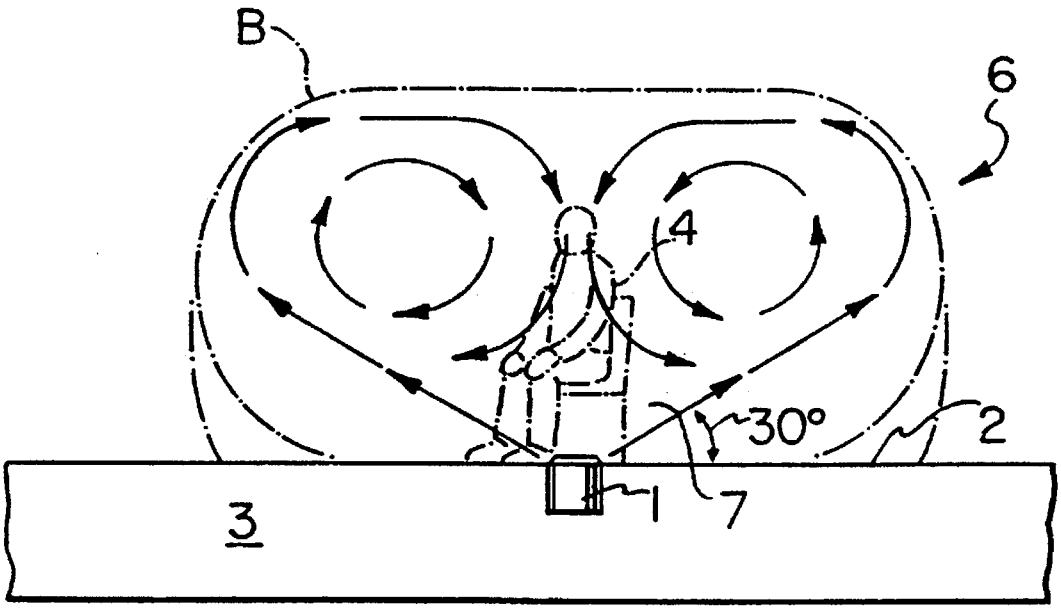
FIG. 1 is a diagram of a localized air pocket formed by an air distribution device in accordance with the invention.

Referring now to FIG. 1, air distribution unit 1 is mounted in an aperture in floor 2 of an open plan building so as to communicate with a plenum space 3 that receives conditioned air from the central building air conditioning system (not shown). The building will normally be designed with a plenum space under each floor instead of with a fully ducted system. Unlike prior art systems, where the pressure in the plenum would typically be 1 or 2 inches of water, the pressure in plenum space 3 is in the order of 0.1" water. A person 4 sits directly over, or at least in the vicinity of, the unit 1.

The distribution unit 1 is designed, in a manner to be described in more detail, to direct the air outwardly and upwardly at an angle of between about 15 and 45 degrees, preferably about 30 degrees to the horizontal.

As a result of directing the air radially outwardly in this fashion, the outflowing air has a vertical component which, as it meets the stationary ambient air 6, causes it to circulate inwardly in a manner shown by the arrows. The outflowing air also creates a reduced pressure zone 7 immediately above the centre of the unit 1. This causes the air to circulate back in on itself creating a substantially closed air pocket B, shown by the broken line, of conditioned air from the unit 1 within the local ambient air 6. Consequently, unlike conventional heating and cooling systems, generally referred to as "air conditioning" systems for the purposes of the specification, the unit 1 is primarily intended to distribute and circulate the conditioned air in a localized environment within the room rather than throughout the room at large. By controlling the outflow of air from the unit 1, the individual 4 can effectively exercise personal control over his or her environment. If each work station is provided with such a distribution unit, each individual can work in different localized environments within a common ambient space.

Figure 2:
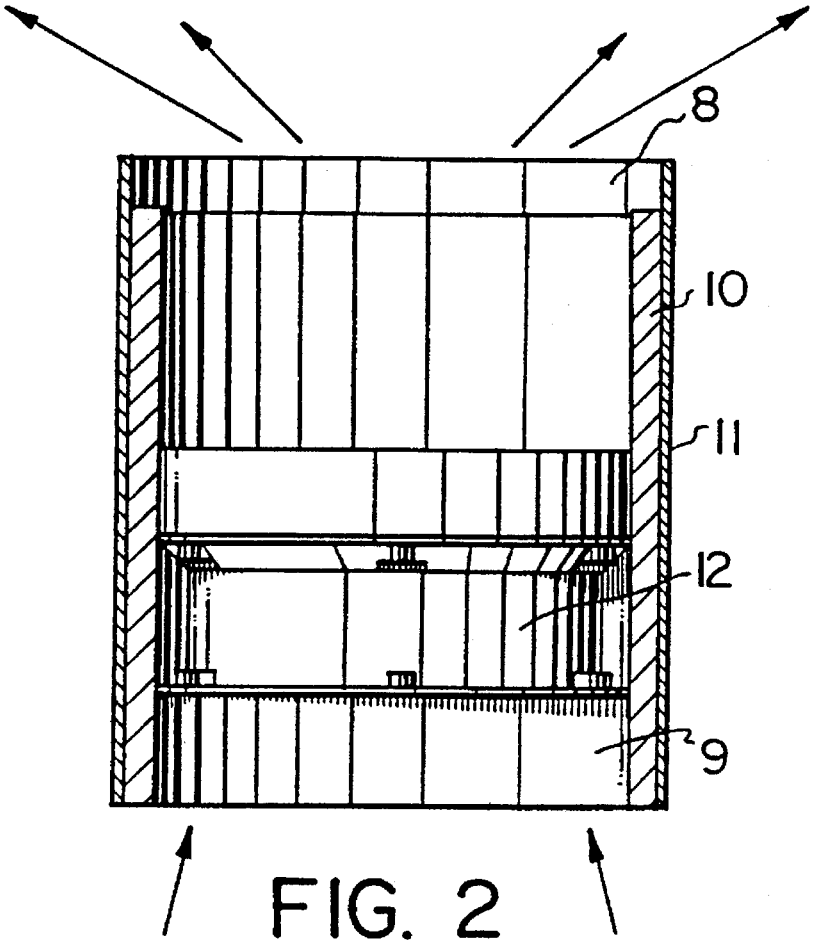
FIG. 2 is a section through a distribution unit in accordance with the invention adapted to be recessed into a floor.

The distribution unit is shown in more detail in FIG. 2. It comprises a grille assembly 8, an acoustically insulating, sound absorbing jacket 10, and an outer cylindrical housing 11. Within the lower part of the housing 11 is mounted an electrically powered fan unit 12, which can be controlled by the individual 4. The fan is mounted on rubber shock absorbers (not shown) to reduce noise. Below the fan 12 is mounted a high efficiency filter 9 for removing particles and other contaminants from the air flowing through the unit 1.

The fan 12 is a.c. powered and phase-controlled to provide a wide range of speed variation at minimum noise levels. A preferred fan is the Comair-Rotron PT 2B3 Patriot fan. This operates from zero to 150 cfm (cubic feet per minute) at a noise level less than 35–0 dB.

Figure 3:
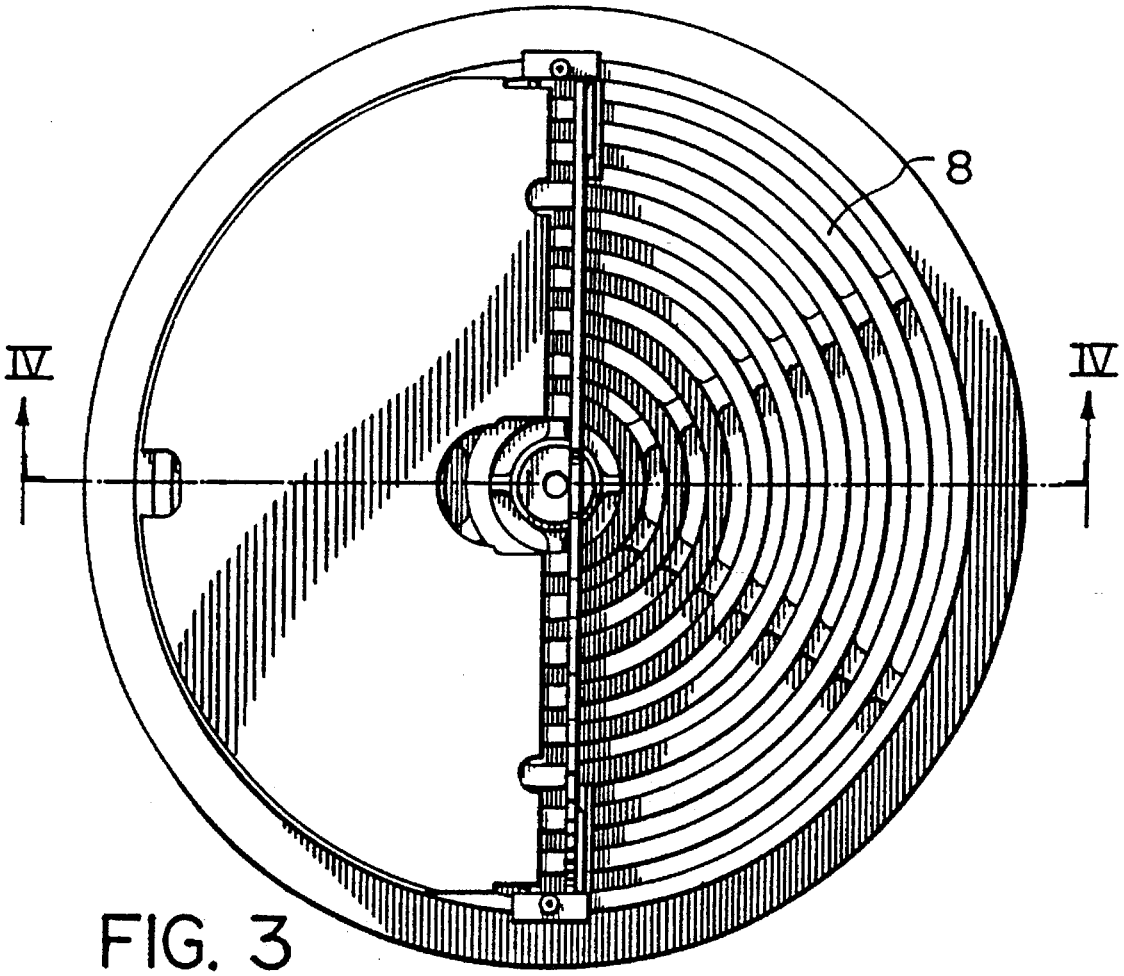
FIG. 3 is an underneath view of the grille assembly of a distribution device in accordance with the invention.
Figure 4:
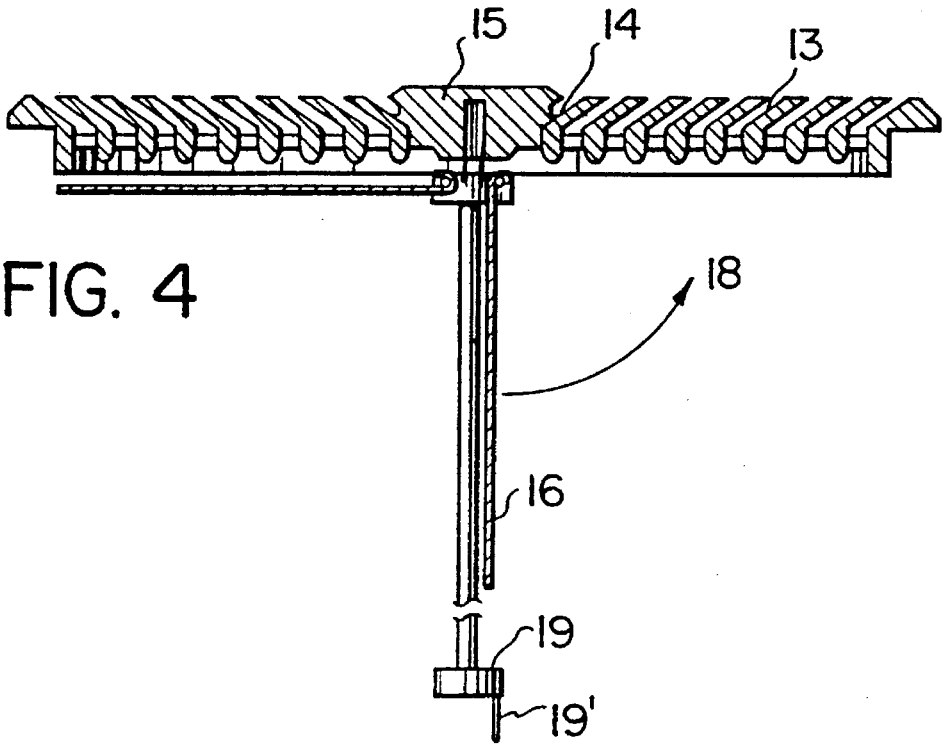
FIG. 4 is a section along the line IV—IV in FIG. 3.

As shown in FIGS. 3 and 4, the grille assembly 8 is milled from a solid block of aluminum to provide radial distribution channels 13 directed upwardly and outwardly at an angle of about 30 degrees to the horizontal and a central aperture 14 closed off by a frictionally inserted plug 15.

The channels 13 are aerodynamically profiled to minimize air resistance and noise. Below the grille assembly 8 is an optional flap valve 16 which can be frictionally adjusted to a desired position on removing the grille assembly 8 to provide course preset control over the air flowing through the plate.

The channels 13 can be machined from a solid metal plate, such as aluminum, or the entire grille assembly 8 can be moulded from plastic.

The plug 15 is also mounted on spindle 18 coupled to potentiometer 19. This is mounted on printed circuit board 19', which provides the control circuit for the fan 12. The potentiometer 19 is held in place by a metal channel brace spanning the diameter of the housing 1. The control circuit varies the phase of the a.c. current supplied to the fan motor, which ensures a wide range of speed control and quiet operation.

In an alternative embodiment the flap valve 16 can be eliminated, in which case the airflow is controlled solely by changing the speed of the fan 12. This can be done either manually or in response to thermostatic control.

Figure 6:
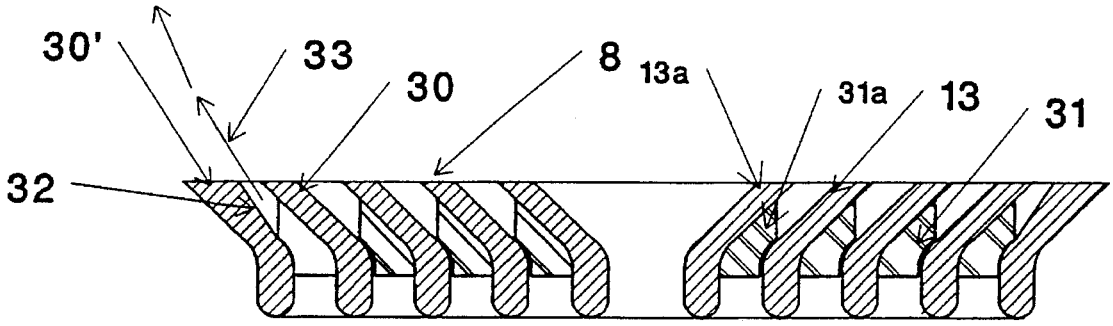
FIG. 6 is a cross section through an alternative grille assembly.

Instead of the grille assembly 8 being milled from a single block, in a preferred embodiment its channels are formed from separate removable concentric rings 30 (FIG. 6) that can be snap-fitted one onto the other. This arrangement enables the grille assembly 8 to be more easily moulded from plastic material with a consequential decrease in the cost of manufacture. The rings 30 are spaced by means of lugs 31 molded integrally with respective associated rings. Lug 31*a* is integral with lug 13*a* and so on. The use of replaceable molded rings also permits grilles of different configuration and diameter to be made up from the same components.

In addition, an important parameter is the angle of inclination of the guide surface 32 of the outermost ring 30'. This can be different from the inclination of the inner channels 13. The airflow coming out of the outer channel is directed more vertically and thus tends to confine the air coming from the inner channels in the desired envelope B. By changing the outer ring 30 the shape of this envelope can be adjusted.

Figure 5:
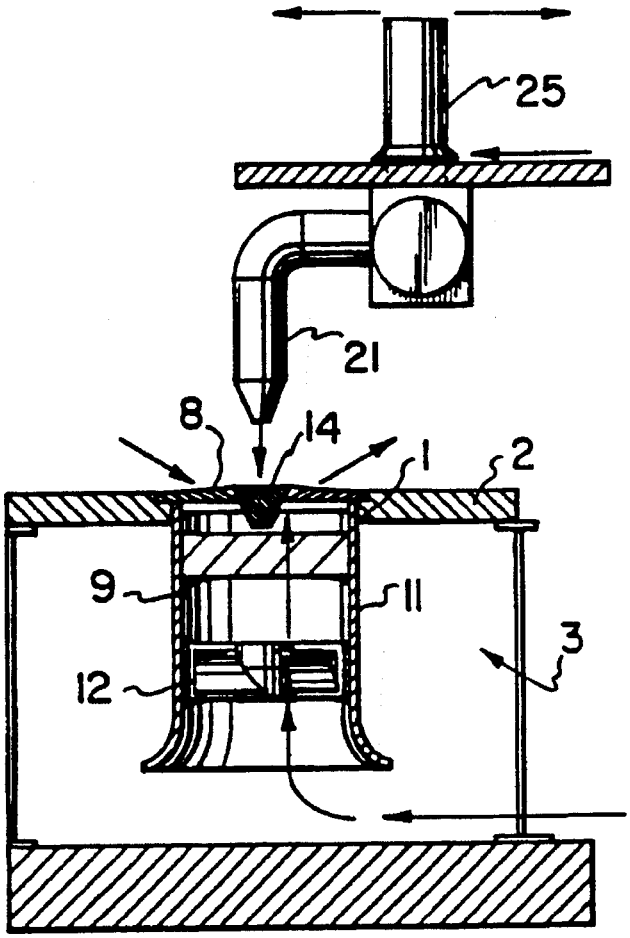
FIG. 5 is a cross section through an assembly showing the air distribution unit as a source of air for a personal environment desk unit.

FIG. 5 shows a distribution unit 1 connected to supply air to a desk-mounted personal air supply system of the type described in our co-pending PCT application Ser. No. CA92/00121. The plug 15 is removed and in its place is inserted a hose 21 connected to a desk-mounted personal environment system. This can further locally condition the air and direct it onto the occupant of a desk, allowing a supply of fresh air conditioned in accordance with personal requirements to be provided.

We claim:

1. An air distribution unit for mounting in the wall or floor of a room having a plenum space behind said wall or floor, comprising a housing having an air inlet for communication with the plenum space and an air outlet; blower means between said air inlet and air outlet for drawing air from the plenum space and exhausting it through the air outlet into the room; and a grille assembly mounted over said air outlet, said grille assembly having circumferentially disposed, aerodynamically profiled air distribution channels extending between the upper and lower surfaces thereof, and said air distribution channels opening out onto the upper surface of the grille assembly at a shallow angle in a radially outward direction so that air flowing out of said channels is directed outwardly at an angle of between about 15° and 45° to the plane of the grille assembly.

2. An air distribution unit as claimed in claim 1, primarily for mounting in a floor, wherein said grille assembly comprises a series of concentric overlapping rings, overlapping portions of said concentric rings having opposed surfaces defining therebetween said air distribution channels, so that air flowing out of said distribution channels at a shallow angle circulates over the unit in a generally closed path to form a local environment zone.

3. An air distribution unit as claimed in claim 2, wherein said concentric rings are interconnected by radial arms dividing said distribution channels into a sectors bounded by the radial arms.

4. An air distribution unit as claimed in claim 3, wherein said overlapping rings and radial arms are in the form of a solid machined plate.

5. An air distribution unit as claimed in claim 3, wherein said grille assembly comprises a plurality of separate overlapping rings, each having circumferentially spaced spacer lugs resting on an underlying ring.

6. An air distribution unit as claimed in any of claims 1 or 2 to 5, further comprising a flap valve hingedly mounted on the underside of said grille assembly to control the volumetric flow rate of air flowing through the unit.

7. An air distribution unit as claimed in claim 1, wherein said housing is an acoustically insulated, cylindrical housing adapted to be recessed into the floor.

8. An air distribution unit as claimed in claim 7, further comprising a plug provided in the center of the grille assembly, said plug being coupled to a control unit in the housing by means of a rod extending into the housing through a central aperture in the grille assembly, whereby said plug can be used to control the blower means.

9. An air distribution unit as claimed in claim 8, wherein said blower means is driven by an electric motor, and said control unit controls the phase of the power supplied to said motor to vary its speed.

10. An air distribution unit as claimed in claim 9, wherein said knob is removably mounted so that when removed it exposes said aperture to permit an air take-off pipe to be coupled thereto.

* * * * *